United States Patent [19]

Ellin

[11] Patent Number: 4,489,443

[45] Date of Patent: Dec. 25, 1984

[54] FORM FOR READY-MADE NECKTIE

[75] Inventor: Roger E. Ellin, Barrington, R.I.

[73] Assignee: Royal Diversified Products, Warren, R.I.

[21] Appl. No.: 523,713

[22] Filed: Aug. 15, 1983

[51] Int. Cl.[3] ..... A41D 25/08

[52] U.S. Cl. ..... 2/153; 2/152 R

[58] Field of Search ..... 2/152 R, 145, 137, 153, 2/154, 150

[56] References Cited

U.S. PATENT DOCUMENTS

| | | | |
|---|---|---|---|
| 3,221,343 | 12/1965 | Phillips et al. | 2/153 |
| 3,222,684 | 12/1965 | Kanter et al. | 2/153 |
| 3,237,208 | 3/1966 | Kanter et al. | 2/153 |
| 3,820,166 | 6/1974 | Gouner | 2/153 |

FOREIGN PATENT DOCUMENTS

| | | | |
|---|---|---|---|
| 804912 | 5/1951 | Fed. Rep. of Germany | 2/145 |

*Primary Examiner*—Werner H. Schroeder
*Assistant Examiner*—Tracy Graveline
*Attorney, Agent, or Firm*—Salter & Michaelson

[57] ABSTRACT

A form for a ready-made necktie includes a form body having a pair of outwardly and rearwardly extending wings, a pair of spaced arms which extend rearwardly from the body adjacent the upper end thereof, a shaft which extends between the arms, a pin which extends rearwardly from the body in downwardly spaced relation to the arms, and a clamping member which is pivotally received on the shaft. The form body is constructed for receiving a permanently tied necktie thereon, and the clamping member of the form is operable for clampingly securing the form and the permanently tied necktie on the collar of a shirt of a wearer. The form body, the arms, the shaft and the pin are adapted for unitary construction, and the clamping member is easily assembled on the shaft so that manufacturing costs are minimized.

2 Claims, 8 Drawing Figures

FORM FOR READY-MADE NECKTIE

BACKGROUND AND SUMMARY OF THE INVENTION

The instant invention relates to a form for receiving a necktie in permanently tied relation thereon to provide a ready-made necktie, the form including means for clampingly securing the ready-made necktie on the collar of a shirt of a user.

The concept of providing a ready-made necktie comprising a form which is clampingly securable on the collar of a shirt of a user and a necktie which is permanently tied on the form is generally known in the art and has been accepted in the trade for years. The U.S. patents to Ellin U.S. Pat. No. 3,426,361 and Najarian U.S. Pat. No. 4,337,539 disclose devices which are generally illustrative in this regard and represent the closest prior art to the instant invention of which the applicant is aware.

While a variety of different types of forms for ready-made neckties have heretofore been available, the heretofore known forms have not been constructed so that they are adapted for relatively inexpensive manufacture. Specifically, they have not been constructed so that the main components thereof can be integrally molded from a plastic material, and they have generally required several manipulative steps in the assemblies thereof.

The instant invention provides a novel construction for a necktie form which overcomes these disadvantages and which is adapted for effective and inexpensive construction. The necktie form of the instant invention generally comprises a form body having a central portion and a pair of wings which extend outwardly and rearwardly from opposite sides of the central portion, a pair of spaced arms which extend rearwardly from the central portion adjacent the upper end thereof, a shaft extending between the arms in rearwardly spaced relation to the central portion, a pin extending rearwardly from the central portion in downwardly spaced relation to the arms, and an elongated clamping member rotatably received on the shaft. The form body, the spaced arms, the shaft, and the pin are preferably integrally molded of a suitable plastic material to provide a simple and inexpensive unitary construction therefor. The clamping member, on the other hand, is preferably constructed of a suitable metal and preferably includes an integrally struck resilient tongue at one end thereof and a pair of legs which coextend with the tongue on opposite sides thereof and terminate in curled knuckles. The clamping member is received on the shaft with the shaft received in the knuckles and the tongue cooperating with the knuckles to maintain the shaft therein. The shaft is preferably formed with a central portion thereof having two substantially flat inner surfaces thereon which are positioned for alternate engagement therewith by the resilient tongue of the clamping member to define open and closed positions of the clamping member, the clamping member being in resiliently biased engagement with the pin in the closed position thereof and extending generally rearwardly from the shaft in the open position thereof. Because of the simple construction of the clamping member and the manner in which it is mounted on the shaft, the clamping member is easily receivable on the pin without substantial manipulative steps during the assembly of the necktie form of the instant invention.

Accordingly, for the above reasons, it is a primary object of the instant invention to provide a form for a ready-made necktie wherein the main components of the form, with the exception of the clamping member thereof, can be integrally formed in a unitary construction.

Another object of the instant invention is to provide a form for a ready-made necktie which can be simply and easily assembled without substantial manipulative steps.

Other objects, features and advantages of the invention shall become apparent as the description thereof proceeds when considered in connection with the accompanying illustrative drawings.

In the drawings which illustrate the best mode presently contemplated for carrying out the present invention:

DESCRIPTION OF THE INVENTION

Figure 1:
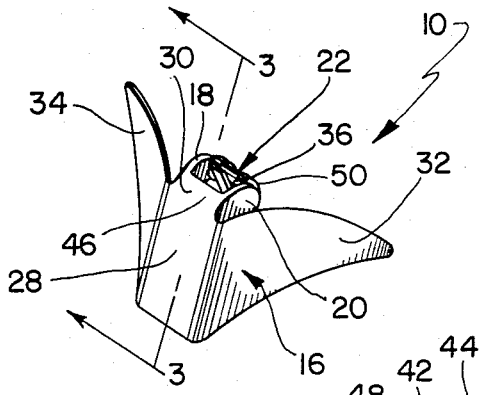
FIG. 1 is a front perspective view of the necktie form of the instant invention.
Figure 2:
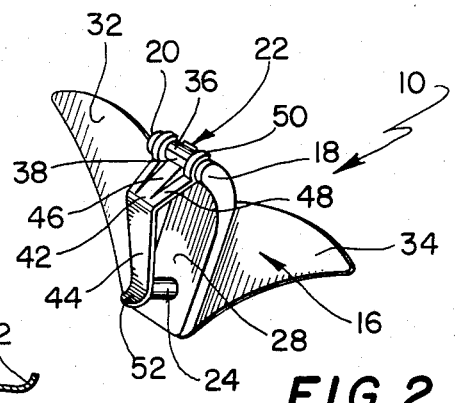
FIG. 2 is a rear perspective view thereof.

Referring now to the drawing, the ready-made necktie form of the instant invention is illustrated and generally indicated at 10 in FIGS. 1 through 8. The form 10 is illustrated in combination with a necktie element 12 in FIGS. 5 through 8, the necktie element 12 being permanently tied on the form 10 in FIGS. 7 and 8 so that the element 12 and the form 10 cooperate to define a ready-made necktie assembly generally indicated at 14.

The form 10 comprises a form body generally indicated at 16, a pair of spaced arms 18 and 20 which extend rearwardly from the body 16, a shaft generally indicated at 22 which extends between the arms 18 and 20, a pin 24 which extends rearwardly from the body 16, and a clamping member generally indicated at 26. The body 16, the arms 18 and 20, the shaft 22, and the pin 24 are preferably molded of a suitable plastic material in a unitary construction. The clamping member 26 is preferably made of a suitable metal and is pivotally received on the shaft 22 so that it is movable between the open position thereof illustrated in FIG. 4 wherein it extends generally rearwardly from the shaft 22 and the closed position thereof illustrated in FIG. 3 wherein it extends generally downwardly from the shaft 22 and engages the pin 24. The clamping member 26 is operable for clampingly securing the form 10 on a collar of a shirt of a wearer so that the collar is interposed between the clamping member 26 and the pin 24 in a manner well known in the art.

Figure 3:
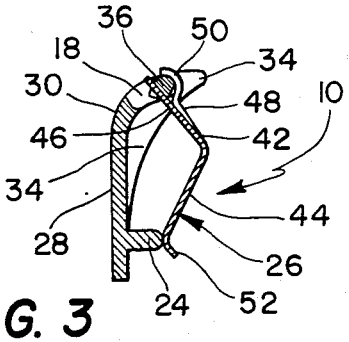
FIG. 3 is a sectional view taken along line 3—3 in FIG. 1.
Figure 4:
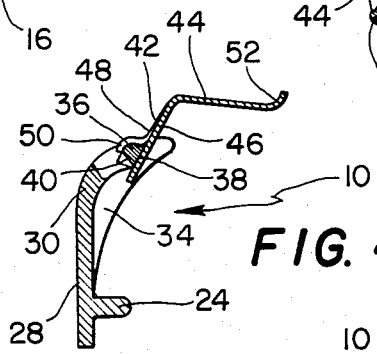
FIG. 4 is a similar sectional view with the clamping member in the open position.
Figure 5:
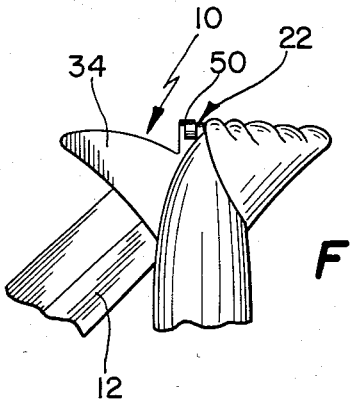
FIGS. 5 and 6 illustrate the tying of a necktie on the form.
Figure 6:
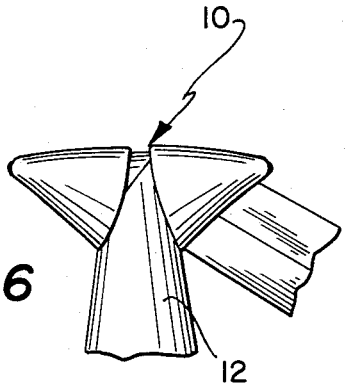
Figure 7:
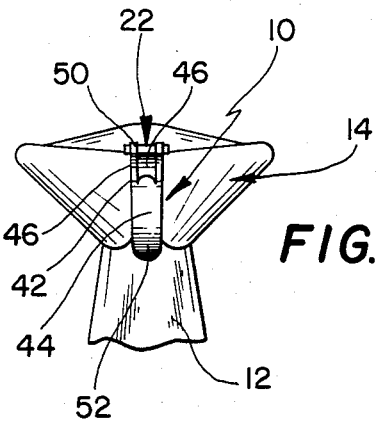
FIG. 7 is a rear elevational view thereof with a necktie received in tied relation thereon.
Figure 8:
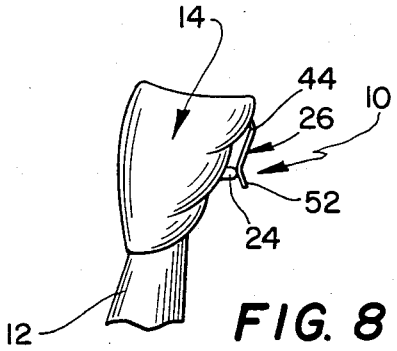
FIG. 8 is a side elevational view of the form.

The form body 16 comprises a central portion 28 of generally rectangular configuration having an upper end 30, and a pair of wings 32 and 34 which integrally extend rearwardly and outwardly from opposite side edges of the central portion 28. As illustrated most clearly in FIGS. 1 and 2, the wings 32 and 34 are of arcuately tapered configuration and extend arcuately rearwardly and outwardly from the central portion 28. The arms 18 and 20 are preferably formed so that they integrally extend in spaced relation arcuately rearwardly from the central portion 28 adjacent the upper end 30 thereof. The pin 24 integrally extends rearwardly from the central portion 28 in downwardly spaced relation to the arms 18 and 20. The shaft 22 preferably integrally extends between the arms 18 and 20 in rearwardly spaced relation to the upper end 30 of the central portion 28. The shaft 22 includes a central portion 36 thereof having first and second substantially flat inner surfaces 38 and 40 which define a generally V-shaped configuration of the central portion 36, as illustrated in FIGS. 3 and 4.

The clamping member 26 comprises an upper portion 42 and a lower portion 44. The upper portion 42 is defined by a substantially flat central elongated tongue 46 and a pair of legs 48 which coextend with the tongue 46 on opposite sides thereof and terminate in curled knuckles 50. The lower portion 44 extends in angular relation from the upper portion 42 and terminates in an outwardly curled lip 52. The clamping member 26 is pivotally received on the shaft 22 so that it is movable between the open and closed positions thereof illustrated in FIGS. 4 and 3, respectively. Specifically, the clamping member 26 is mounted on shaft 22 so that the shaft 22 is received in the knuckles 50, and the tongue 38 is on the opposite side of the shaft 22 from the knuckles 50. Accordingly, the tongue 46, which is preferably at least slilghtly resilient, functions to maintain the knuckles 50 in engagement with the shaft 22. Further, the clamping member 26 is positioned on the shaft 22 so that the tongue 46 engages the central portion 36 and so that when the clamping member 26 is in the open position thereof illustrated in FIG. 4, the tongue 46 engages the surface 38; whereas when the clamping member 26 is in the closed position thereof illustrated in FIG. 3, the tongue 46 engages the surface 40. Accordingly, when the clamping member 26 is either in the open or closed positions thereof, it is releasably locked in position as a result of the resiliently biased engagement of the tongue 46 with one of the surfaces 38 or 40. The clamping member can, however, be moved between the open and closed positions thereof when desired by manipulating the clamping member 26 to cause the tongue 46 to be cammed outwardly so that the clamping member 26 can be freely moved to the opposite respective position thereof.

It is seen, therefore, that the instant invention provides an effective form for receiving a necktie element in a permanently tied relation to provide a ready-made necktie assembly. The form 10 is easily operable between the open and closed positions thereof, illustrated in FIGS. 3 and 4, respectively, and it provides certain advantages over the heretofore-known ready-made necktie forms. Specifically, the form body 16, the legs 18 and 20, the shaft 22 and the pin 24 can all be integrally molded of a suitable plastic material for an efficient and inexpensive construction. The clamping member 26 is also adapted for efficient and inexpensive construction via a series of die stamping and forming steps, and the clamping member 26 is easily assembled on the shaft 22 by simply urging the tongue 46 outwardly so that the shaft 22 can be received in the knuckles 50. For these reasons, as well as the other reasons hereinabove set forth, it is seen that the ready-made necktie form of the instant invention represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A form for a ready-made necktie and the like comprising:

a. a form body having a central portion with front and rear sides and a pair of wings which extend outwardly and rearwardly from opposite side edges of said central portion;

b. an arm which extends rearwardly from said central portion adjacent the upper end thereof;

c. a shaft attached to said arm in rearwardly spaced relation to said central portion, said shaft having two substantially flat inner surfaces, which are disposed in angular relation to define a generally V-shaped sectional configuration of said shaft;

d. a pin extending rearwardly from said central portion, said pin being spaced downwardly from said arm and said shaft;

e. an elongated clamping member having first and second ends, said clamping member having an integrally struck resilient tongue at said first end thereof and being received on said shaft so that said tongue is in resiliently biased engagement therewith and so that said clamping member is pivotable between an open position wherein it extends generally rearwardly from said body and a closed position thereof wherein it is in engagement with said pin, said tongue engaging one of said shaft flat inner surfaces when said clamping member is in the open position thereof and engaging the other of said shaft flat inner surfaces when said clamping member is in the closed position thereof.

2. In the form of claim 1, said shaft further characterized as having a rounded surface which extends between said flat surfaces thereof, said clamping member having a pair of legs which coextend with said tongue on opposite sides thereof and terminate in curled knuckles at said first end of said clamping member, said tongue and said knuckles being disposed on opposite sides of said shaft, said knuckles traveling over said rounded surface during movement of said clamping member between said open and closed positions thereof and cooperating with said tongue to retain said clamping member on said shaft.

* * * * *